US008769906B2

(12) United States Patent
Standal et al.

(10) Patent No.: US 8,769,906 B2
(45) Date of Patent: Jul. 8, 2014

(54) REINFORCEMENT SYSTEM FOR CONCRETE STRUCTURES AND A METHOD FOR REINFORCING AN ELONGATE CONCRETE STRUCTURE

(75) Inventors: Per Cato Standal, Nesoya (NO); Leonard W. Miller, Lysaker (NO)

(73) Assignee: ReforceTech Ltd., Limrick (IE)

( * ) Notice: Subject to any disclaimer, the term of this patent is extended or adjusted under 35 U.S.C. 154(b) by 0 days.

(21) Appl. No.: 13/582,376

(22) PCT Filed: Mar. 1, 2011

(86) PCT No.: PCT/NO2011/000069

§ 371 (c)(1), (2), (4) Date: Sep. 11, 2012

(87) PCT Pub. No.: WO2011/108941

PCT Pub. Date: Sep. 9, 2011

(65) Prior Publication Data

US 2013/0047545 A1 Feb. 28, 2013

(30) Foreign Application Priority Data

Mar. 3, 2010 (NO) ..... 20100293

(51) Int. Cl.
*E04H 12/00* (2006.01)

(52) U.S. Cl.
USPC ..... 52/649.5; 52/649.8; 52/745.21

(58) Field of Classification Search
USPC ..... 52/649.1, 649.2, 649.5, 649.8, 745.21
See application file for complete search history.

(56) References Cited

U.S. PATENT DOCUMENTS

| | | | | |
|---|---|---|---|---|
| 3,238,688 | A | 3/1966 | Schoch et al. | |
| 3,797,193 | A | 3/1974 | Haller et al. | |
| 4,667,452 | A * | 5/1987 | Dick et al. | 52/649.1 |
| 5,392,580 | A * | 2/1995 | Baumann | 52/660 |
| 6,003,281 | A * | 12/1999 | Pilakoutas | 52/742.14 |
| 7,396,496 | B2 | 7/2008 | Bull | |
| 7,516,589 | B2 * | 4/2009 | Messiqua et al. | 52/646 |

(Continued)

FOREIGN PATENT DOCUMENTS

| | | |
|---|---|---|
| DE | 1007982 B | 5/1957 |
| GB | 1 300 079 | 12/1972 |
| WO | WO-2007/053038 | 5/2007 |

OTHER PUBLICATIONS

International Search Report dated May 30, 2011 as received in corresponding PCT Application No. PCT/NO2011/000069, 3 pages.

*Primary Examiner* — Brian Glessner
*Assistant Examiner* — Brian D Mattei
(74) *Attorney, Agent, or Firm* — Foley & Lardner LLP

(57) ABSTRACT

A reinforcement system for concrete structures, comprising a first set of reinforcement elements configured to be connected to and co-functioning with a second set of reinforcement elements, each of said first and second set of reinforcement elements comprises each a number of more or less uniformly shaped units, intended to be tied together' the first and/or second set of reinforcement elements being made of basalt or carbon fibers, embedded in a suitable matrix. At least the units forming said first set of reinforcement elements are delivered to the construction site in a flat packed, compact state, each unit of said first reinforcement elements being configured to be stretched out into longer lengths when placed in situ and preferably being interconnected to at least several of the other units of said first reinforcement elements by means of at least one flexible or foldable, more or less continuous band.

6 Claims, 5 Drawing Sheets

(56) References Cited

U.S. PATENT DOCUMENTS

2001/0023568 A1* 9/2001 Edwards et al. ..... 52/649.1
2004/0231278 A1* 11/2004 Yin ..... 52/649.4
2006/0059804 A1* 3/2006 Brown ..... 52/223.13
2006/0137282 A1* 6/2006 Anvick et al. ..... 52/649.1
2007/0039277 A1* 2/2007 Mossbeck ..... 52/649.1
2008/0263989 A1* 10/2008 Bull ..... 52/600

* cited by examiner

Interlocking Windings without top and bottom carpets
Top View

Reinforced Tape for forming U shaped Carpets
In Red

REINFORCEMENT SYSTEM FOR CONCRETE STRUCTURES AND A METHOD FOR REINFORCING AN ELONGATE CONCRETE STRUCTURE

CROSS REFERENCE TO RELATED APPLICATIONS

The present application is a National Stage of International Application No. PCT/NO2011/000069 filed on Mar. 1, 2011, which claims the benefit of Norwegian Patent Application No. 20100293 filed on Mar. 3, 2010. The entire disclosures of which are incorporated herein by reference.

THE TECHNICAL FIELD OF THE INVENTION

The present invention relates to a reinforcement system for concrete structures, comprising a first set of reinforcement elements configured to be connected to and co-functioning with a second set of reinforcement elements, each of said first and second set of reinforcement elements comprises a number of more or less uniformly shaped units, intended to be tied together, the first and the second set of reinforcement elements being made of basalt or carbon fibers or glass fibers, embedded in a suitable matrix.

Further, the present invention also relates to a method for reinforcing an elongate concrete structure, such as a wall element, beam, column, etc., where the reinforcement comprises at least a first and second set of reinforcement elements, each set comprising a number of more or less uniformly shaped units, intended to be assembled and tied together prior to concreting inside and around which, concrete is intended to be poured.

BACKGROUND FOR THE INVENTION

When constructing concrete structure, it is common practice to use formwork in which steel reinforcement is placed, assembled and inter-tied in situ, prior to concreting. Such in situ placed and assembled reinforcement commonly requires a large number of manhours. The reinforcement is made from straight bars, pre-bent bars and stirrups which are tied together in the formwork prior to concreting. In many instances, the bars are pre-cut and bent and to an extent handled by cranes. Such bars may have a length of for example 20 m and a diameter in the range of for example 10 mm-50 mm, each bar thus representing a large weight and being heavy to handle for the operators placing the reinforcement.

Further, it is common practice to prefabricate steel reinforcement cages in a sheltered store and then transport the preassembled cage on trucks to the construction site for placement in the formwork, thereby reducing the time spent on site for handling and placing, such operations being performed by means of lifting cranes.

Recently it has also been proposed to make the reinforcement of carbon or basalt fibers, embedded in a resin matrix. Reference is made to the applicants own U.S. Pat. No. 7,396,496, the content of which hereby being incorporated by the reference with respect to the prefabrication of reinforcement structure for a concrete pillar. According to U.S. Pat. No. 7,396,496 reinforcement is made of carbon or basalt fibers, forming bars, spirals or reinforcement nets.

US 2008/0263989, also belonging to the applicant, disclose reinforcement comprising at least one or more loops with closed ends, forming end anchorage for the reinforcement US 2008/0263989 is hereby incorporated by the reference.

There is a need for a reinforcement system which is easy to handle without having to depend on heavy use of cranes for lifting heavy reinforcement units or bars and which still is flexible in use and easy to adapt to the various concrete structured and shapes to be concreted. Further, there is a requirement for a system requiring a minimum of manhours to produce a complete, reinforced structure, ready for concreting. A still further requirement is to arrive at a reinforcement system where the need for concrete coverage is reduced to a minimum without putting the concrete structure at a risk for failure due to corrosion or the like.

SUMMARY OF THE INVENTION

An object of the invention is to provide a reinforcement system which is easy to handle both during transport, assembling and placing in the form work and where the manhours required for completing the assembly of reinforcement is minimized.

A further object of the invention is to improve the quality of a concrete structure and its structural integrity, and still being able to reduce the concrete coverage.

Another object of the present invention is to reduce assembly cost, need for use of heavy duty cranes and manhours required for placing of reinforcement in a concrete structure to be cast and to avoid use of stools or stirrups for separating the various reinforcement elements.

Another object of the invention is to eliminate the use of numbers of tools by using partial pre-tensioning of for example three cross basalt fiber reinforced plastics (BFRP) reinforcement bars, such that they hold the remaining cages in place allowing for a reduction in costs associated with labor and increasing dimensional accuracy of the position of the basalt fiber reinforcement cage.

Another object of the present invention is to reduce the weight and volumes required for transporting the reinforcement material from the site of manufacture to the construction site.

Yet another object of the present invention is to enhance production and assembly of more or less completed prefabricated reinforcement systems wherein the various elements of the reinforcement system are transported as separate, flat packed units which easily may be handled by an operator.

Yet another object of the present invention is to provide a reinforcement system requiring as little concrete coverage as possible, if any, thus functioning in an optimal manner.

A still further object of the invention is to provide a lightweight reinforcement concept, easily handled by one or more operator, where it is possible to prefabricate as much as possible of a tailor fit reinforcement system at a fabrication yard and transport such tailor made reinforcement in a flat pack condition for installation at a construction site without having to make many modifications or additional reinforcing operations.

A still further object of the present invention is to provide a system which may easily be adapted to various complicated shapes without substantially increasing the fabrication cost for the reinforcement required or the construction costs for placing the reinforcement.

A still further object of the present invention is to provide a concrete structure with improved fire resistance without having to increase concrete coverage or reinforcement complexity.

The objects according to the present invention are achieved by a reinforcement system as further defined by the independent claims. Various embodiments of the present invention are defined by the dependent claims.

According to the present invention, the reinforcement system for concrete structures comprises a first set of reinforcement elements configured to be connected to and co-functioning with a second set of reinforcement elements, each of said first and second set of reinforcement elements comprising a number of more or less uniformly shaped units, intended to be tied together, the first and/or second set of reinforcement elements being made of basalt or carbon fibers, embedded in a suitable matrix. At least the units forming said first set of reinforcement elements are delivered to the construction site in a flat packed, compact state, each unit of said first reinforcement elements being configured to be stretched out into longer lengths when placed in situ and preferably being interconnected to at least several of the other units of said first reinforcement elements by means of at least one flexible or foldable, more or less continuous band.

According to one embodiment of the invention, said units of said second set of reinforcement elements also are delivered in a flat packed state and preferably having a more or less uniform shape, each unit of said second set of reinforcement elements preferably being interconnected to at least several of the other units of said second set of reinforcement elements by means of at least one flexible or foldable, more or less continuous band.

Further, according to a further embodiment, said first set of reinforcement may be made up of a plurality of separate loops; or continuous windings or coils. Alternatively, said first set of reinforcement may be in the form of a number of separate J-, L- or U-shaped bars.

The second set of reinforcement elements may preferably, but not necessarily, be in the form of more or less parallel straight, J-, L- or U-shaped or similar shaped bars, interconnected by one or more flexible or foldable bands extending in lateral direction with respect to said bars, fixing at least several of said bars, in spaced relation to each other and enabling the bar reinforcement to be delivered in a rolled up mat (10) or flat pack configuration.

According to an embodiment, the band(s) may preferably be in the form of tape with an adhesive surface at least on one side of the tape, and that a part of the surface of the units of the reinforcement elements lies in direct contact with the adhesive surface on the tape, interlinking and retaining the units of the reinforcement elements in a predesigned position, forming a carpet or a looped, wound or coiled unit. A second tape, which preferably has an adhesive surface, is placed on top of said already placed tape, covering the opposite surface of the bars, thus fixing the position of the bars from being displaced laterally or axially.

For one type of reinforcement for a slab type of structure, carpet(s) of straight bars are in a threaded position in a central opening formed by a series of adjacently positioned loops, said carpet(s) being placed and fixed on a inner sides of the opening of the loops, windings or coils.

Carpets may be placed on top of and below a series of adjacently placed loops, the bars of the carpet(s) being fixed to said loops. If it is desirable to strengthen bars of a structure, the reinforcement bars may be threaded through the loops between parallel rows of loops are given a larger diameter than the diameter of the bars of the carpet, thus providing a reinforced beam structure along said joint.

According to the present invention, at least the first set of reinforcement elements, comprising several looped, winded or coiled units, interconnected by means of at least one interconnecting band, is delivered to a construction site in a reduced volume, flat packed condition and is then stretched out to its full length in the formwork in situ whereupon the second set of the reinforcement elements bars are placed in intended position with respect to said first set of stretched out reinforcement elements and then tied together.

Said second set of reinforcement elements, which may comprise a number of juxtaposed straight bars, interconnected by at least one band forming a carpet, are delivered to the construction site in a reduced volume, flat packed condition and the stretched out on top of and tied to said already placed first set of reinforcement element and/or also placed below the first set of reinforcement prior to the placing of said first set of reinforcement element. Further, said second set of reinforcement elements, which comprises a number of juxtaposed straight bars, may preferably be interconnected by at least one band forming a carpet, is delivered to the construction site in a reduced volume, flat packed condition and threaded into a series of adjacently arranged looped, winded or coiled units of the first set of reinforcement elements and then tied together at the various points of contact.

According to an embodiment of the present invention, at least a second row of said first set of reinforcement elements, comprising several looped, winded or coiled units, is arranged adjacent said first row in an overlapping configuration, thereby providing a row of closed loop like opening, into which a number of straight reinforcing bars, preferably with lager diameters than the reinforcement bars incorporated in the carpet, are treaded and tied to the contacting points, thereby providing a reinforcement for an incorporated integrated beam, for example in the slab structure.

According to the present invention one embodiment may use a combination of prefabricated carpets, delivered as rolled up "carpets" and loops, either delivered as single loops to be incorporated into the carpet or as coils delivered in a compressed state and extended by an axial pull at the construction site as a step in the laying process of reinforcement prior to concreting. Alternatively, the reinforcement may be delivered to the site in a pre-fabricated or assembled state, more or less ready to be laid directly in the formwork.

According to the present invention the system is easy to handle at the construction site, reducing the need for heavy lifting facilities. It is also possible to use smaller handling devices and fastening mechanisms in the installation phase. At the same time less labor manhours are required at the construction site to install the system together with faster installation due to thinner and lighter designs.

Due to the use of basalt fibers as main material for the reinforcement, maintenance costs are reduced, due to the absence of corrosion and consequential spalling or degradation. In addition the life cycle of the product becomes longer.

It should also be appreciated that a combination of mats and windings or loops permits fast assembly reducing, although mot necessarily eliminating the use of stools and ties, thus reducing manhours.

SHORT DESCRIPTION OF THE DRAWINGS

One or more embodiments of the present invention shall now be described in detail, referring to the drawings, where:

DETAILED DESCRIPTION OF THE INVENTION

Figure 1:
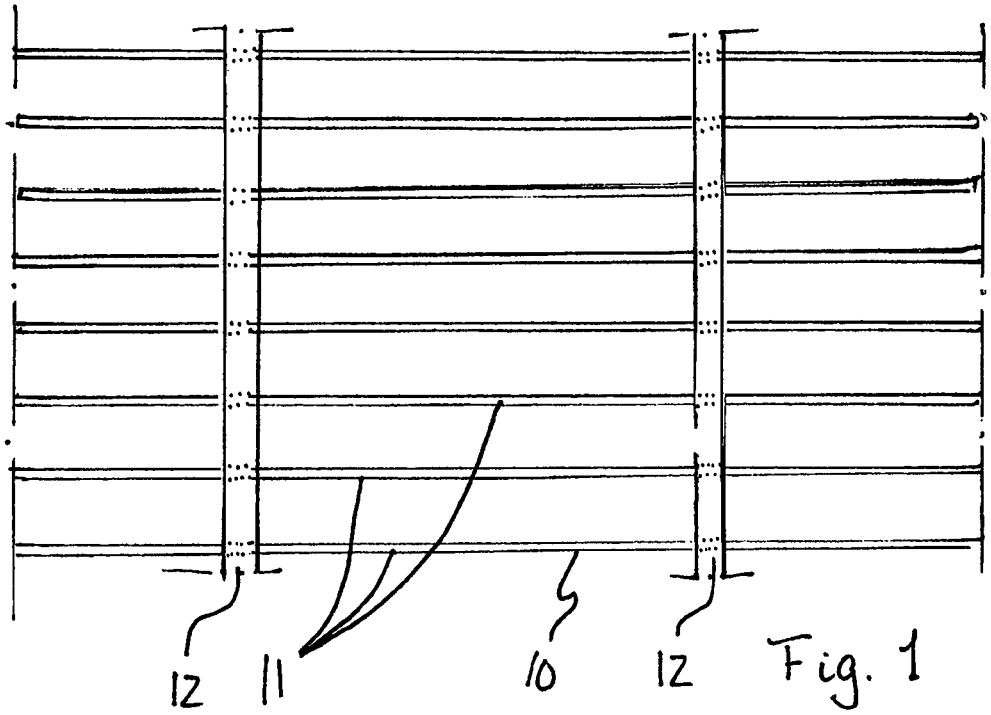
FIG. 1 shows schematically a top view of a reinforcement net or carpet according to the present invention, delivered to the construction site as a rolled-up "carpet"

FIG. 1 shows schematically a reinforcement net or carpet 10 according to the present invention in a rolled out and stretched state. As indicated in the Figure, the net 10 comprises a number of straight bars 11 arranged in parallel and tied together by means of laterally arranged bands or strips 12. The number of bars 11, the distance apart in stretched mode, the size and diameter of the bars 11 are governed by the specific intended use and may be varied without thereby deviating form the inventive concept. The band or strips 12 may be of a flexible type with an adhesive surface at least on one of band. In order to obtain a proper fixture of the bars 11, two bands or strips 12 may for example be adhered together on a piggyback basis, arranged and fixed to the rods or bars 11 on each side, thereby interlocking the bars 11 in a secure and fixed position. The tape used for establishing the band 12 should preferably be of a type allowing the assembled carpet to be rolled into a roll. Tape available on a commercial scale in the market may be used, the only real purpose of the tape(s) being to establish a carpet, connecting the reinforcement bars 11 together in an adjustable, spaced relation or to be compacted for transport, storing, handling and placing in a formwork in a rolled up state, still keeping the straight bars 11 in a parallel, predesigned spaced relation for the intended purpose. Although the Figure discloses an embodiment where two bands 12 are shown, it should be appreciated that a plurality of transverse bands 12 may be used, depending upon the length of the bars 11 and the intended purpose of the carpet 10.

The bars may preferably be made of a number of basalt fibers, embedded in a suitable matrix, cured in a proper manner so as to form straight, relatively rigid bars. 11. The number of fibers used in a bar 11 depend on the required dimension and/or strength.

Figure 2:
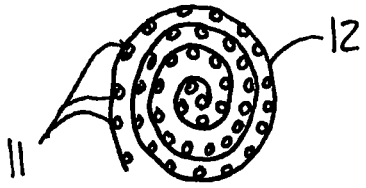
FIG. 2 shows schematically an end view of the reinforcement net or carpet shown in FIG. 1 in a rolled-up state according to the present invention.

FIG. 2 shows the reinforcement net or carpet 10 shown in FIG. 1 in a rolled-up or bundled state according to the present invention. According to the embodiment indicated in the FIG. 2, the tapes or the bands 12 are only attached to one side of the bars 11. As an alternative way of compacting and/or flat packing, the carpet may be delivered in stacks or the like.

Figure 3:
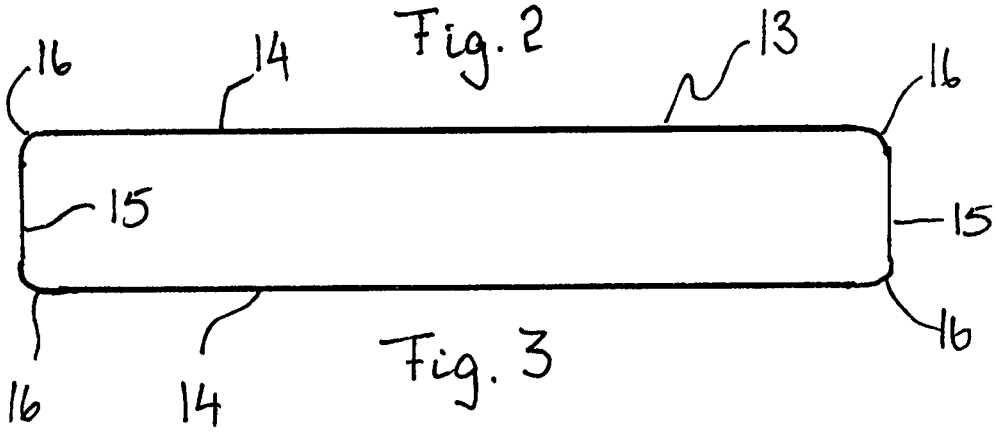
FIG. 3 shows schematically one embodiment of a suitable loop according to the present invention.
Figure 8:
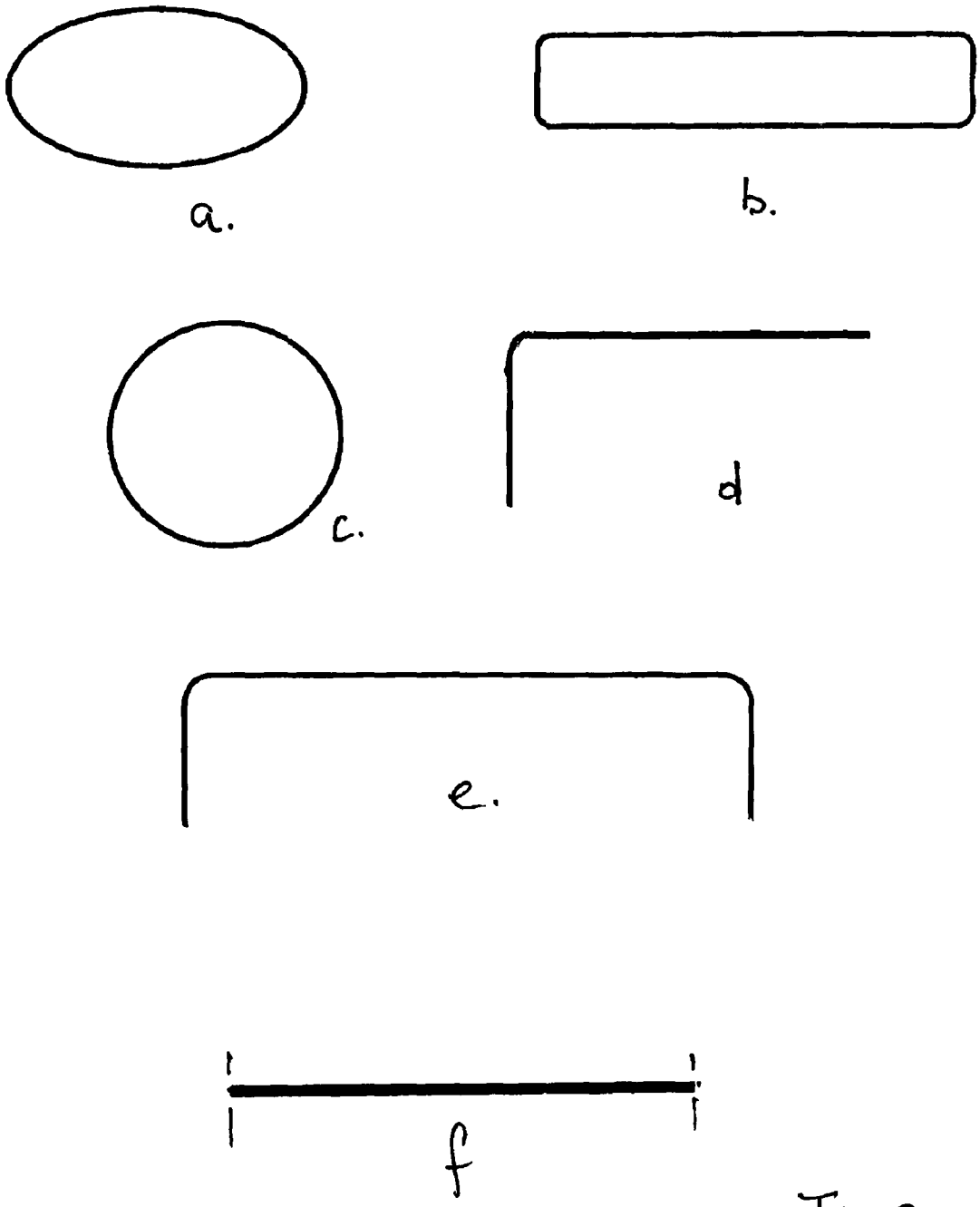
FIG. 8 shows schematically a few possible shapes for the reinforcement to be applied in connection with a carpet according to the present invention.

FIG. 3 shows schematically one embodiment of a suitable closed loop 13 according to the present invention. The loop 13 shown is provided with two longitudinal sides 14 and two short transverse ends 15, said two longitudinal sides 14 and said two short transverse sides 15 being interconnected by means of curved corners 16. Examples of other shapes of the reinforcement units to form part of a carpet 10 are shown in FIG. 8.

Figure 4:
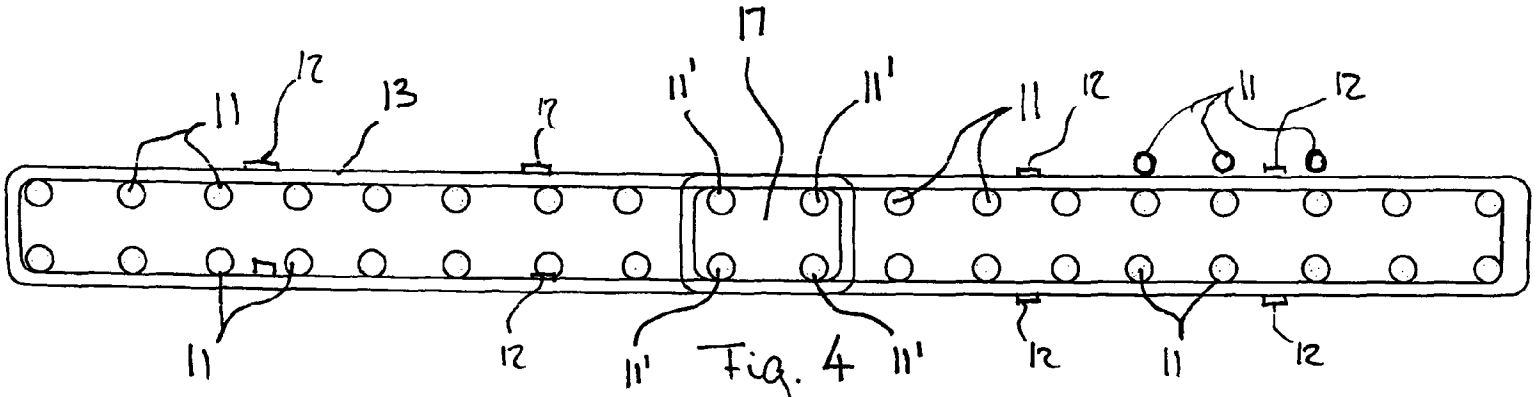
FIG. 4 shows schematically a cross section through another embodiment of the present invention.

FIG. 4 shows schematically an end view of two rows of loops 13 in an over-lapping mode, assembled and interconnected with carpets 10 of straight bars 11. Each row of loops 13 comprises a large number of individual, separate loops 13, more or less of the shape as indicated in FIG. 3. Said loops 13 in a row may be interconnected by one or more flexible bands 12 either attached to the outer surface of the two longitudinal sides 14 of the loops 13 and/or the corresponding internal surfaces of said longitudinal sides 14. Two (or more) loops 13 are arranged as pairs in a parallel spaced relation in two rows. Such bands 12 may interconnect both the upper and lower longitudinal sides 14 on one loop 13 in a row with the corresponding longitudinal sides 14 of the neighboring loops 13. Hence a series of loops may be compacted and transported, stored and handled as the compact entity in the same manner as for the straight bar carpet described in connection with FIGS. 1 and 2.

As further indicated in the Figure, pairs of loops 13 are used, the loops 13 in each pair 13 being configured in an overlapping pattern, i.e. that one end of a first loop 13 in each pair overlaps one end of a second loop 13 in the pair. Further, according to the embodiment indicated in FIG. 4, a carpet 10 is rolled out resting on the inner surface of the longitudinal side 14 of the first set of loops 13, configured in such way that the direction of bands 12 are parallel with the main direction of loops 13. It should be appreciated that also a corresponding net 10 is intended to be attached to the inner surface of upper longitudinal side 14 of the loop 13. For clarity, however, such second net 10 is not shown.

The overlapping ends of the loops 13 in each pair form a duct or a space through which straight bars 11 are threaded and fixed to the inner surface at least of the curved corners 16 of each end and possibly to the transverse ends 15 and/or possibly also to the longitudinal part 15, if the dimensions or load transfer capacity so require.

On the opposite side of the overlapping ends of the loops 13, the mats 10 have not yet been installed. The loops become rather rigid and can be joined by normal metal wire tying techniques using steel wire, stainless steel wire or coated steel wires and automatic or manual tying. Normal stools and supports can be used to link the vertical wall to the forms or position within the forms.

Although only two rows are indicated in the Figure, it should be appreciated that the number of row may be any number from 1 and upwards, dependent upon use, shape and type of construction to be made.

The assembled cage according to this embodiment comprises a large number of pairs of loops 13 in each row, of which only one pair is shown, in an overlapping configuration, wherein a secondary "closed" additional loop 17 is formed as part of the overlapping pattern and configuration. Further, the bars 11 of the net 10 are arranged inside the parts of the loops 13 falling outside said "closed" loop 17, attached to the two inner surface of the loops 13, i.e. the upper and lower, inner surface of said parts of the loops 13. In the "closed" loops 17, additional bars 11' are arranged in a configuration as shown. These bars 11' are inserted from one end of the "closed" loop 17 formed by the overlapping ends of the loops 13. The diameter of the bars 11' may be larger than the diameter 11 of the bars outside said "closed" loop 17, whereby an inherent beam construction may be provided in the concreted end product, making such part of the structure more rigid than the remaining parts of the structure. Further, it should be appreciated that the number of the bars and/or the density of the bars may be elected so as to further increase the beam effect of this portion of the structure. As further seen in the Figure, the straight bar carpet is arranged inside the loop 13. It should be appreciated, however, that said carpets, as indicated in FIG. 4, may be place on top of or below each row of loops without deviating from the present invention. The bars should preferably be arranged in such way that a bar 13 is arranged at each corner bend 16, thus enhancing the stiffness of the construction.

The reinforcement cage as shown in FIG. 4 may either be preassembled off-line in a work shop, for example in a sheltered environment, then transported to the construction site and then lifted into the formwork, optionally assembled and linked with other preassembled or assembled in situ placed. Alternatively, the carpet 10 may be threaded into the loops 13 from one end, linking the straight bars 11 with the loops 13 in situ.

It should be appreciated that although only two loops 13 in a pair are shown, it should be appreciated that the number of loops 13 in a "pair" may chosen from one to a large number, depending upon the intended structure to be fabricated.

Figure 5:
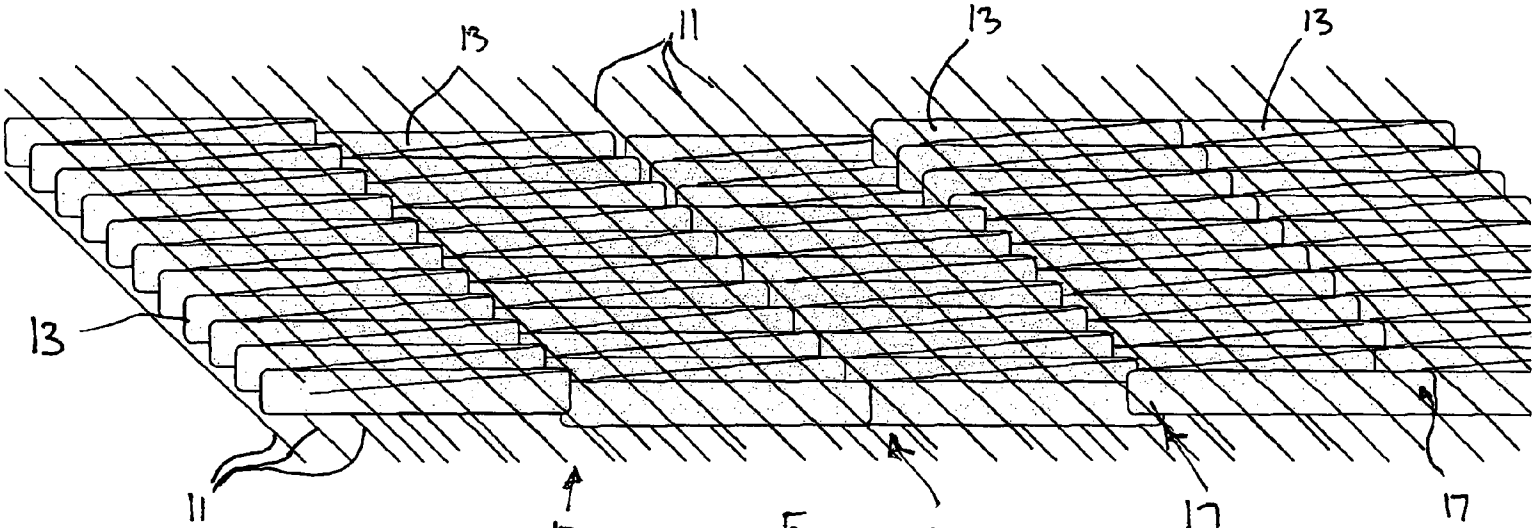
FIG. 5 shows five windings stretched in two directions between nets in the form of two pieces.

FIG. 5 shows schematically a five row loop windings 13 stretched in two directions between an upper and lower set of nets 10, while the number of pairs of loops 13 in a row is twenty-one in the shown embodiment. Further, the loops 13 in the row are configured in such way that two adjacent ends of the loops 3 are attached in an alternating manner, thus forming a zig-zag or wound/coiled pattern. That is to say, one end of a loop 13 is fixed to the neighboring end of an adjacent loop 13, while the opposite end of the neighboring loop 13 is fixed to the adjacent end of the next loop 13 and so on. According to this embodiment, a slab having four beams 17 incorporated in concreted. A further major difference between the embodiment shown in FIG. 5 and the embodiment indicated in FIG. 4 is that the "loops" are made of windings of a continuous string, given a nearly closed loop shaped form. According to the embodiment shown, the "loop" has a rectangular shape. It should be appreciated, however, that the shape of such "loop" may for example be square, polygonal, oval or round, dependent upon and adapted to the shape of the concreted end product.

Figure 6:
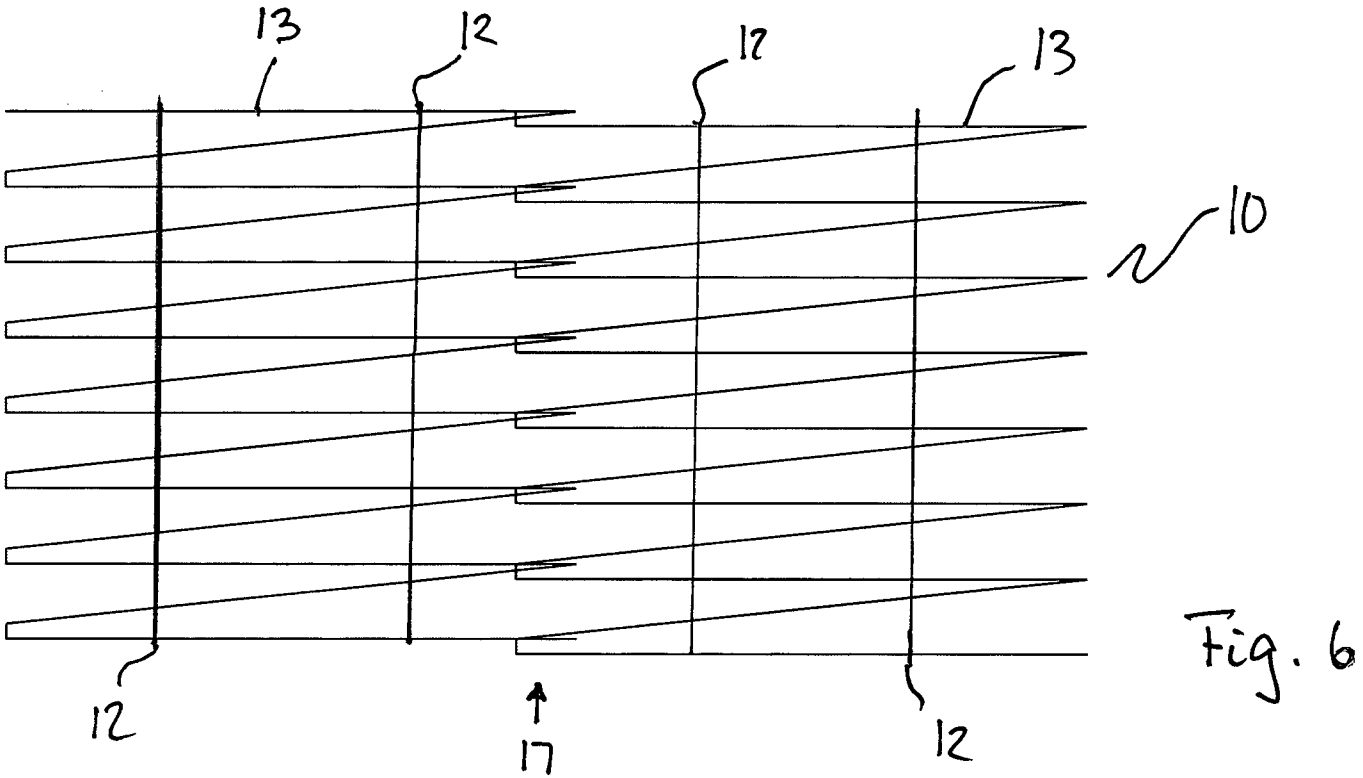
FIG. 6 shows schematically two of the adjacently arranged rows of loops in n two carpets, shown in FIG. 5, configured in an overlapping configuration as indicated in FIG. 4, without showing the carpets of straight bars according to the present invention.

FIG. 6 shows schematically two of the adjacently arranged rows of loops in two of the carpets, shown in FIG. 5, configured in an overlapping configuration as indicated in FIG. 4, without showing the associated carpets of straight bars according to the present invention. In the overlapping part, the central loops 17 are indicated.

Figure 7:
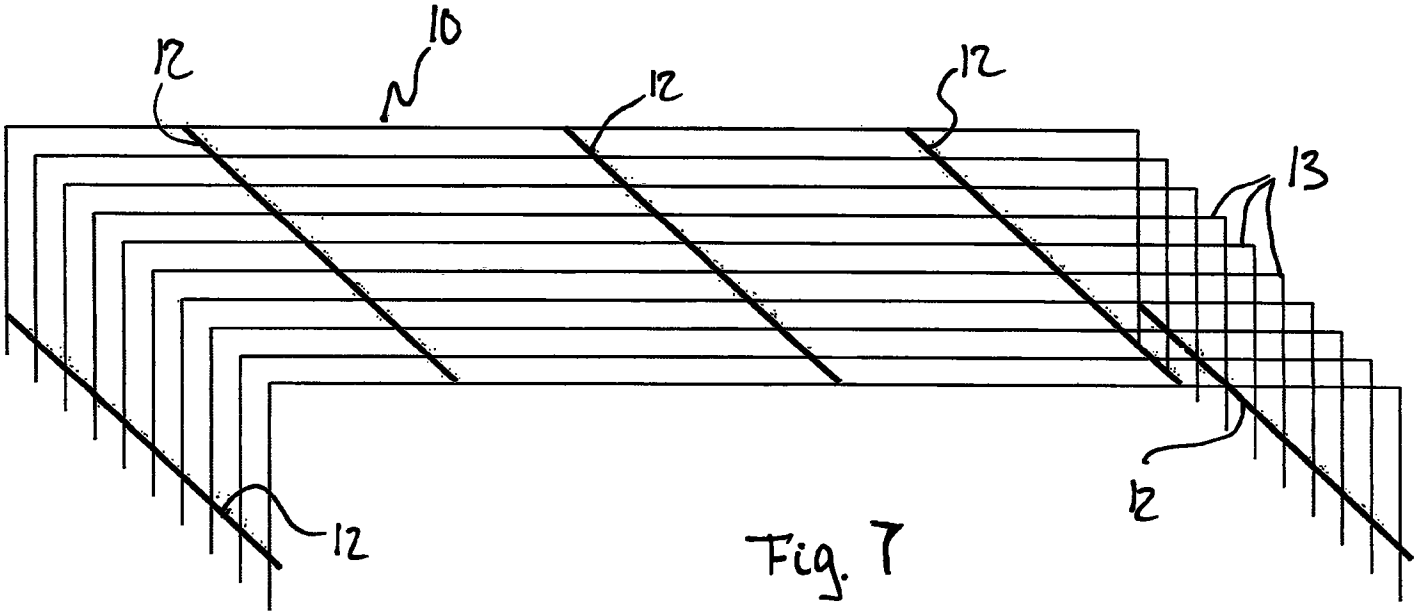
FIG. 7 shows schematically a reinforcement carpet in stretched out mode, made of U-shaped reinforcement units, interconnected or tied together by bands.

FIG. 7 shows schematically a reinforcement carpet in stretched out mode, made of U-shaped reinforcement units, interconnected or tied together by bands 12. For reason of clearness and simplicity; the carpets 10 of straight bars 11 are not shown. Such reinforcement may for example be used in conjunction with building pontoons or the like.

FIG. 8*a-f* shows schematically a few possible shapes for the reinforcement to be applied in connection with a carpet according to the present invention.

The reinforcement system according to the present invention is for example well suited for use in connection with tunnel lining elements. For such application, structural integrity during and after a fire is of great importance. Hence, it is of importance to maintain the structural strength of the reinforcement also subsequent to a fire. Further, due to limited space use of heavy lifting facilities are also prohibited.

Further, it should be appreciated that loop as such still contributes to the structural integrity of the concrete structure exposed to a fire, since the matrix is burned out, while the basalt fibers remain intact. Hence, the concrete structure will also be able to withstand the fire destruction test and still be capable of holding own weight.

It should also be appreciated that due to the non-corrosive properties of basalt, the need of concrete coverage may be eliminated, or at least largely reduces, thus permitting the concrete to be thinner, and hence lighter for shipping and more easy to handle by the operator installing the reinforcement or the concrete element.

Even though the system according to the present invention is disclosed in connection with a slab like concrete structure, the loops being evenly distributed along the length of the structure, it should be appreciated that the loop shaped windings or coils may be configured in any other way, such as to function as reinforcement for a curved structure, such as an arc, an U-shaped structure, a torso or the like without deviating from the inventive idea.

Further, although the first set of reinforcement is in the form of loops, helicals with a circular or four sided form, it should be appreciated that the form may be polygonal, oval etc. Further, said first set of reinforcement elements may have an L-shape, a U-shape or J-shape without deviating from the inventive idea.

Correspondingly, although the second set of reinforcement elements are disclosed as straight bars, it should be appreciated that these may be curved, or for example have an L-shape, a U-shape or J-shape without deviating from the inventive idea.

Still further, the distance between each winding, loop or coil in a row does not necessary have to be equal, such distance may be varied dependent upon type and magnitude of appearing forces, design etc.

It should be appreciated that term "carpets" used herein, is meant to mean a number of more or less uniformly shaped reinforcement units arranged more or less in a parallel position with respect to each other, interconnected or tied together by means of one or more, preferably at least two or more flexible, bendable bands, arranged in such way that the carpet may be in a compressed, compact state during transport and storing and stretched out more or less to its full length in an installed state in a formwork, the maximum distance between each reinforcement unit being decided by the length of the bands between two adjacent reinforcement units.

When for example assemble the two rows of loops 13 as disclosed above, one possible way of establishing a reinforcement will be described below, indicated one sequence of steps that may be used.

1. The material, i.e. bundle of the loops 13, is laid out such that a minimum of time is needed during assembly to fix a next part for assembly. It should be appreciated that the loops or the bars are not able to be bent on site, but are pre-bent at the fabrication plant. Further, it should be appreciated that it is possible to cut reinforcement by using a hand saw or bolt cutters. For tying the various elements together, i.e. for example tie a loop 13 and a straight bar 11 together, steel wires, stainless steel wires, plastic coated wires of plastic strips may be used. Stools may be used, based on industry practice. If a bar is broken, a similar length of a bar 70-80 cm long may be used, tying the broken parts together.
2. The windings from a bundled set is set on ground and a carpet 10 of straight bars 11, in compacted form, is threaded in through the bundle of loops 13, lying on the inner surface of the elongate part 14 of the loop.
   The winded or separate loops 13 are stretched out and secured at at each end to the front bar 11 of a carpet, such that the center-center (C-C) distances are for example 10 cm. The bottom carpet 11 is the also stretched inside in lateral direction inside the loop along the bottom of the winding also at 10 cm C-C. Each bar at each end of the winding are tied to the corresponding loop and ties arc further added as necessary to secure the carpet to the windings. The carpet 10 is not stretched out in the entire lateral length of the loop, in order to enable an overlapping configuration, ref. step 4 below. Further, several bars are tied in the center of the windings as further necessary to secure the carpet 10 to the windings or loops. It should be appreciated, however, that each intersection between a winding/loop and the bars needs not to be tied, as bond strength to the concrete is the strengthening mechanism, not the tie in itself. The reinforcement according to the present invention may be very elastic and may be temporarily offset during concreting. It should be appreciated, however, that the reinforcement will move back to its original relaxed state as a consequence of use of a vibrator.

Upon completed tying, this first section of reinforcement is lifted on to stools for correct height according to engineering drawings.

3. A top carpet is laid on top of the windings or attached to the lower surface of the upper elongate member 14 of the loops. The top carpet is secured to the loops/windings in a similar way as described above.

4. Winding No. 2 is laid in a corresponding way on the foundation area and thereupon assembled in a corresponding manner. When the winded loops and carpets are completed tied, this second interlocked winding is lifted into place in an overlapping configuration with the referenced first interlocked set of windings. Additional reinforcement bars are then threaded into the closed loop 17 formed by the overlapping configuration and tied to the loop, ref description above.

5. If further rows with windings are required the above described procedure is repeated.

6. Concrete may now be poured as per normal practice.

The invention claimed is:

1. Reinforcement system for concrete structures, comprising:

a first set of reinforcement elements comprising several looped, winded or coiled units; and a second set of reinforcement elements, the first set of reinforcement elements configured to be connected to and co-functioning with the second set of reinforcement elements, each of said first and second set of reinforcement elements comprises a number of uniformly shaped units, configured to be tied together, the first and/or second set of reinforcement elements being made of basalt or carbon fibers, embedded in a matrix, wherein at least the units forming said first set of reinforcement elements are arranged in a flat packed, compact state, configured to be delivered to a construction site, each unit of said first reinforcement elements being configured to be stretched out into longer lengths when placed in situ and being interconnected to at least several of the other units of said first reinforcement elements by means of being fixed to at least one flexible or foldable continuous hand, where the first set of reinforcement elements comprises a set of reinforcement elements of straight bars in a threaded position in a central opening formed by a series of adjacently positioned loops of the first set of reinforcement elements, said set of reinforcement elements being placed and fixed on inner sides of the opening of the loops, windings or coils of the first set of reinforcement elements.

2. Reinforcement system for concrete structures according to claim 1, where the units of said second set of reinforcement elements also are arranged in a flat packed state and have a uniform shape, and are configured to be delivered to the construction site, each unit of said second set of reinforcement elements being interconnected to at least several of the other units of said second set of reinforcement elements by means of at least one flexible or foldable, continuous band.

3. Reinforcement system according to claim 1, where mats are placed on top of and below a series of adjacently placed loops, the bars of the mats being fixed to said loops.

4. Reinforcement system according to claim 1, where the bars threaded through the loops between two parallel rows of loops are given a larger diameter than the diameter of the bars of the set of reinforcement elements, thus providing a reinforced beam structure in a joint.

5. Method for reinforcing an elongate concrete structure, where the reinforcement comprises at least a first and second set of reinforcement elements, each set comprising a number of uniformly shaped units, configured to be assembled and tied together prior to concreting, to form reinforcement, inside and around which concrete is poured, comprising:

providing at least the first set of reinforcement elements, comprising several looped, winded or coiled units, interconnected by means of being fixed to at least one interconnecting flexible band, arranged in a reduced volume, flat packed condition and configured to be delivered to a construction site;

stretching out the first set of reinforcement elements to its full length in formwork in situ;

placing the second set of the reinforcement elements as reinforcement bars in position with respect to said first set of stretched out reinforcement elements; and then tying the first and second sets of reinforcement elements together, where at least a second row of said first set of reinforcement elements, comprising several looped, winded or coiled units, is arranged adjacent a first row in an overlapping configuration, thereby providing a row of closed loop like opening, into which a number of straight reinforcing bars, with larger diameters than the reinforcement bars incorporated in the second set of reinforcement elements, are threaded and tied to the contacting points, thereby providing a reinforcement for an incorporated integrated girder.

6. Method according to claim 5, where said second set of reinforcement elements, which comprises a number of juxtaposed straight bars, interconnected by at least one band forming a carpet, are arranged in a reduced volume, flat packed condition, and further comprising:

stretching out the second set of reinforcement elements on top of and tying the second set of reinforcement elements to said first set of reinforcement elements and/or placing the second set of reinforcement elements below the first set of reinforcement elements prior to the placing of said first set of reinforcement elements.

* * * * *